US011278788B2

(12) United States Patent
Shigeta

(10) Patent No.: US 11,278,788 B2
(45) Date of Patent: Mar. 22, 2022

(54) PACKING BOX OF PLAYING CARDS

(71) Applicant: ANGEL GROUP CO., LTD., Shiga (JP)

(72) Inventor: Yasushi Shigeta, Shiga (JP)

(73) Assignee: ANGEL GROUP CO., LTD., Shiga (JP)

( * ) Notice: Subject to any disclaimer, the term of this patent is extended or adjusted under 35 U.S.C. 154(b) by 0 days.

(21) Appl. No.: 16/162,891

(22) Filed: Oct. 17, 2018

(65) Prior Publication Data

US 2019/0105553 A1 Apr. 11, 2019

Related U.S. Application Data

(63) Continuation of application No. 15/638,904, filed on Jun. 30, 2017, now Pat. No. 10,143,911, which is a (Continued)

(30) Foreign Application Priority Data

Aug. 5, 2012 (JP) ..... 2012-182741

(51) Int. Cl.
*A63F 1/06* (2006.01)
*A63F 1/14* (2006.01)
(Continued)

(52) U.S. Cl.
CPC ..... *A63F 1/062* (2013.01); *A63F 1/10* (2013.01); *A63F 1/12* (2013.01); *A63F 1/14* (2013.01);
(Continued)

(58) Field of Classification Search
CPC .... A63F 1/062; A63F 1/10; A63F 1/12; A63F 1/14; A63F 2009/242; A63F 2009/2489;
(Continued)

(56) References Cited

U.S. PATENT DOCUMENTS 945,868 A 1/1910 Sanguinette
1,404,945 A 1/1922 Epstein
(Continued)

FOREIGN PATENT DOCUMENTS

GB 1218016 A * 1/1971 ..... B65D 17/462
JP 2002172013 A 6/2002
(Continued)

OTHER PUBLICATIONS

International Application No. PCT/JP2012/008036, International Search Report dated Feb. 5, 2013.

*Primary Examiner* — Bryon P Gehman
(74) *Attorney, Agent, or Firm* — Norton Rose Fulbright US LLP

(57) ABSTRACT

A packing box for packaging of playing cards has, in an assembled state, a shape of a rectangular parallelepiped with six faces including front and rear faces, right and left side faces, and top and bottom faces. The packing box includes cut lines in two locations at a predetermined interval in parallel with a longitudinal direction of the rectangular parallelepiped, and a central band in a portion defined by the cut lines provided in the two locations. The right and left side faces of the packing box can be removed along the cut lines such that side edges of the playing cards within the packing box are exposed.

23 Claims, 8 Drawing Sheets

Related U.S. Application Data continuation of application No. 13/958,407, filed on Aug. 2, 2013, now Pat. No. 9,724,594.

(51) Int. Cl.

| | |
|---|---|
| ***A63F 1/10*** | (2006.01) |
| ***A63F 1/12*** | (2006.01) |
| ***B65D 5/54*** | (2006.01) |
| *B65D 75/58* | (2006.01) |
| *B65D 75/54* | (2006.01) |
| *A63F 9/24* | (2006.01) |

(52) U.S. Cl.

CPC ..... *B65D 5/54* (2013.01); *A63F 2009/242* (2013.01); *A63F 2009/2489* (2013.01); *A63F 2250/58* (2013.01); *B65D 75/54* (2013.01); *B65D 75/58* (2013.01); *B65D 75/5805* (2013.01); *B65D 75/5827* (2013.01); *B65D 75/5833* (2013.01); *B65D 75/5838* (2013.01); *B65D 75/5844* (2013.01)

(58) Field of Classification Search

CPC ..... A63F 1/06; A63F 2250/58; B65D 5/54; B65D 75/54; B65D 75/5405; B65D 75/541; B65D 75/5415; B65D 75/58; B65D 75/5805; B65D 75/5827; B65D 75/5833; B65D 75/5838; B65D 75/5844

See application file for complete search history.

(56) References Cited

U.S. PATENT DOCUMENTS

| | | | | |
|---|---|---|---|---|
| 1,848,764 | A | 3/1932 | Beyer | |
| 2,141,752 | A | 12/1938 | Hoarle | |
| 2,315,136 | A | 3/1943 | Platkin | |
| 2,430,707 | A | 11/1947 | Cahn | |
| 2,447,279 | A * | 8/1948 | Rosenfeld | A63F 1/06 206/315.1 |
| 2,533,577 | A | 12/1950 | Godfrey | |
| 2,577,007 | A | 12/1951 | Dubilier | |
| 3,071,244 | A | 1/1963 | Doran | |
| 3,286,830 | A | 11/1966 | Robb, Jr. | |
| 3,388,853 | A | 6/1968 | Matich, Jr. | |
| 3,858,717 | A | 1/1975 | Peters | |
| 4,111,297 | A | 9/1978 | Paulin | |
| 4,784,261 | A | 11/1988 | Kutchin | |
| 7,866,667 | B2 * | 1/2011 | Fruchtman | A63F 1/06 273/148 A |
| 8,985,321 | B2 * | 3/2015 | Philips | B65D 5/5445 206/45.29 |
| 2002/0153272 | A1 | 10/2002 | Rapoza | |
| 2003/0024841 | A1 | 2/2003 | Murphy | |
| 2006/0191426 | A1 | 8/2006 | Timmerman | |
| 2007/0120321 | A1 | 5/2007 | Fruchtman | |
| 2010/0155292 | A1 | 6/2010 | Fell et al. | |
| 2010/0314834 | A1 | 12/2010 | Shigeta | |
| 2010/0327525 | A1 | 12/2010 | Shigeta | |
| 2011/0130185 | A1 | 6/2011 | Walker | |
| 2012/0318703 | A1 | 12/2012 | Fell et al. | |

FOREIGN PATENT DOCUMENTS

| | | | |
|---|---|---|---|
| JP | 2002284151 | A | 10/2002 |
| JP | 2004035095 | A | 2/2004 |
| JP | 2006335384 | A | 12/2006 |
| JP | 2011024603 | A | 2/2011 |
| JP | 3167277 | | 4/2011 |
| WO | 2000071438 | A1 | 11/2000 |
| WO | 2007062701 | A1 | 6/2007 |
| WO | 2009-069708 | A1 | 6/2009 |

* cited by examiner

PACKING BOX OF PLAYING CARDS

CROSS-REFERENCE TO RELATED APPLICATIONS

The present application is a continuation application from U.S. application Ser. No. 15/638,904 filed Jun. 30, 2017, which is a continuation from U.S. application Ser. No. 13/958,407 filed Aug. 2, 2013, which claims priority to Japanese Application No. JP 2012-182741 filed Aug. 5, 2012; the content of each is incorporated herein by reference in its entirety.

TECHNICAL FIELD

The present invention relates to playing cards used in card games, and particularly, to shuffled playing cards packed as an individual pack after being shuffled in a random manner, a packing box for packing an individual set of playing cards.

BACKGROUND

In poker, baccarat, bridge, blackjack, and other card games, a dealer sets one or more decks of playing cards in a card shooter or the like, and deals cards to game players by shooting the cards one by one out of the card shooter or the like. In so doing, to ensure fairness of the games, the cards need to be dealt at random. Therefore, a game host has to sufficiently shuffle the playing cards randomly in order to ensure a random order of arrangement of the playing cards before the playing cards are set in the card shooter.

It should be noted that a conventional card shuffling device for shuffling cards is disclosed in, for example, WO 2009/069708.

SUMMARY OF INVENTION

The shuffled playing cards used in various card games such as poker, baccarat, bridge or blackjack include, ordinary, 416 cards if eight decks of cards are used. Eight decks of playing cards have 416 cards, and the height thereof is approximately 125 mm. Therefore, when the dealer tries to set such 416 playing cards in a card shooter or the like at one time, it may be impossible to house the cards neatly since they get misaligned, which is a problem and hampers the efficient operation of the games. There is also a problem of possible cheating such as the insertion/removal or switching of cards when the cards are housed in a card shooter.

The present invention has been made in view of the above problems, and aims to provide a packing box of playing cards and shuffled playing cards with which the game host can readily set playing cards in a card shooter or the like prior to a game, and that can eliminate the possibility of cheating.

To achieve the above object, the present invention provides a packing box of playing cards that has, in an assembled state, a shape of a rectangular parallelepiped with six faces that are front and rear faces, right and left side faces, and top and bottom faces, and encases the playing cards, the packing box including zippers or cutoff units in two locations at a predetermined interval, the zippers or the cutoff units including cut lines in parallel with a longitudinal direction of the rectangular parallelepiped shape, and a central band in a central portion defined by the zippers or the cutoff units provided in the two locations, wherein the right and left side faces of the packing box can be removed by removing the zippers or the cutoff units such that side faces of the playing cards are exposed.

To achieve the above object, the present invention provides shuffled playing cards that are housed in a packing box and encased therein in a shuffled state, and sealed, the shuffled playing cards containing a number of cards that can form a predetermined number of decks, the packing box being a packing box that has a shape of a rectangular parallelepiped with six faces that are front and rear faces, right and left side faces, and top and bottom faces, and that has zippers or cutoff units in two locations at a predetermined interval, the zippers or the cutoff units including zipper lines or cut lines in parallel with a longitudinal direction of the rectangular parallelepiped shape, and a central band provided in a portion defined by the zippers or the cutoff units provided in the two locations, wherein the right and left side faces of the packing box can be removed by removing the zippers or the cutoff units along the zipper lines or the cut lines such that side faces of the playing cards are exposed.

With the present invention, it is possible to achieve an easier handling of a predetermined number of decks of shuffled playing cards to be used in card games so that the cards can be set to a shoe in a safe and reliable manner, thereby improving the operability of games at casinos, reducing the operation cost and improving safety.

DETAILED DESCRIPTION OF EMBODIMENTS

Figure 1A:
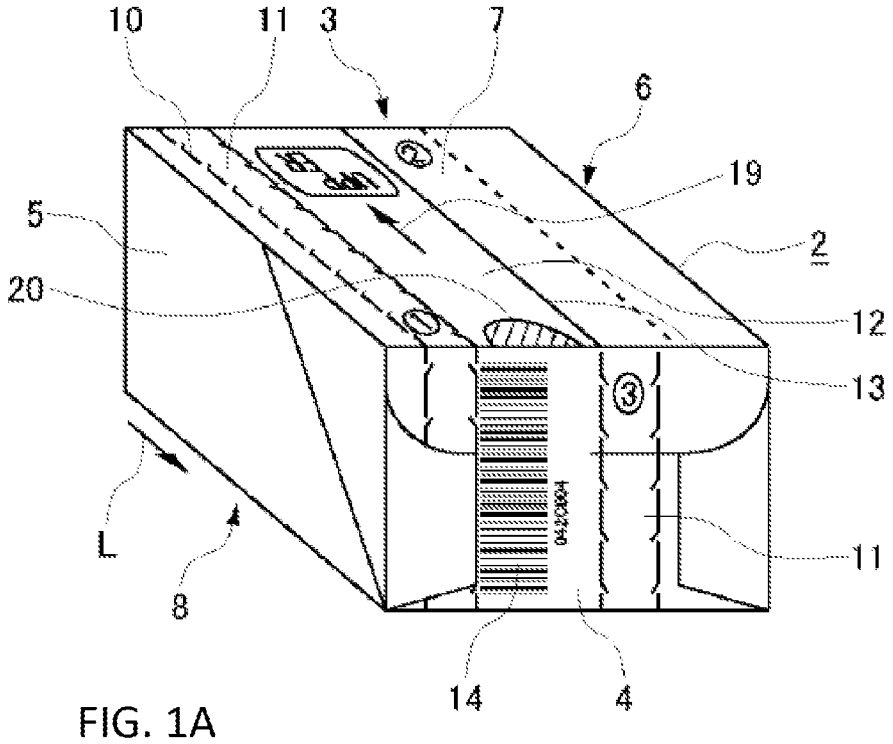
FIG. 1A is a perspective view of a packing box packing shuffled playing cards according to Embodiment 1 of the present invention.
Figure 1B:
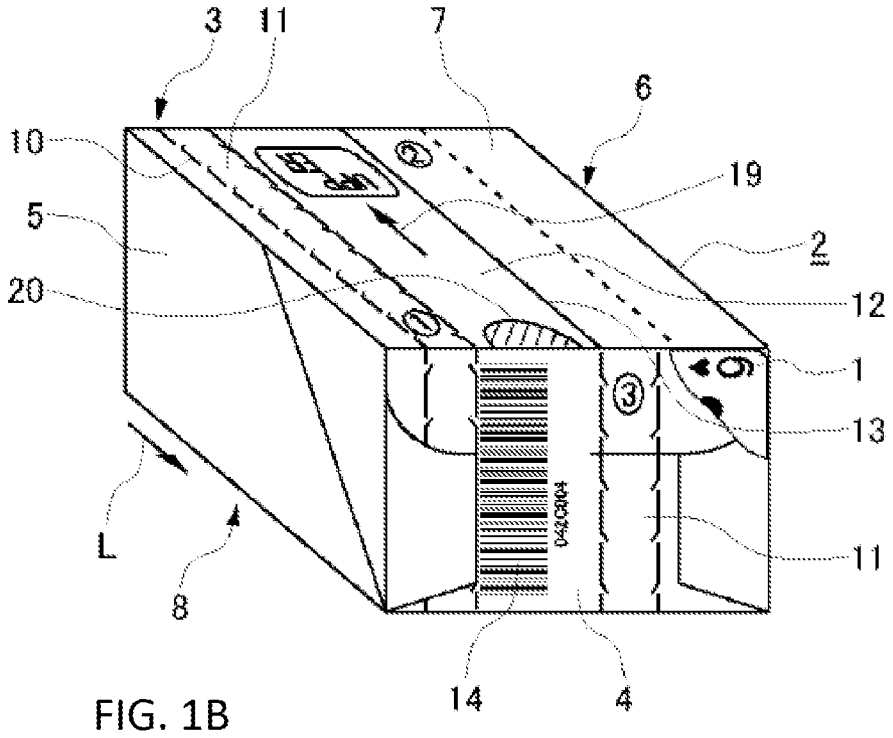
FIG. 1B is a perspective view showing a state in which the packing box packing the shuffled playing cards is partially broken to show a portion of the cards.

Embodiment 1 of the present invention will be described with reference to the attached drawings. FIGS. 1A and 1B are perspective views each illustrating a packing box of Embodiment 1 packing shuffled playing cards. A packing box 2 of shuffled playing cards 1 has the shape of a rectangular parallelepiped with six faces, namely, a front face 3, a rear face 4, a left side face 5, a right side face 6, a top face 7 and a bottom face 8 so as to encase the shuffled playing cards 1 in an assembled state. The packing box 2 includes zippers 11 provided in two locations at a predetermined interval, each of which includes zipper-shaped cut lines 10 arranged in parallel with a longitudinal direction (an arrow L) of the rectangular parallelepiped shape, and has a central band 12 in the central portion defined by the zippers 11 provided in the two locations.

The central band 12 is colored so as to be readily distinguishable from the other portions. As described in detail later, a configuration is achieved in which by removing the two zippers 11 along the cut lines 10 formed by zipper lines or a straight slit 13, the left and right side faces 5 and 6 of the packing box 2 are removed such that the side edges of the shuffled playing cards 1 would be exposed. Note that it is possible to configure the zipper 11 as a cutoff unit to enable a cut along the cut line 10 with a thread or the like, as a variation.

Figure 2:
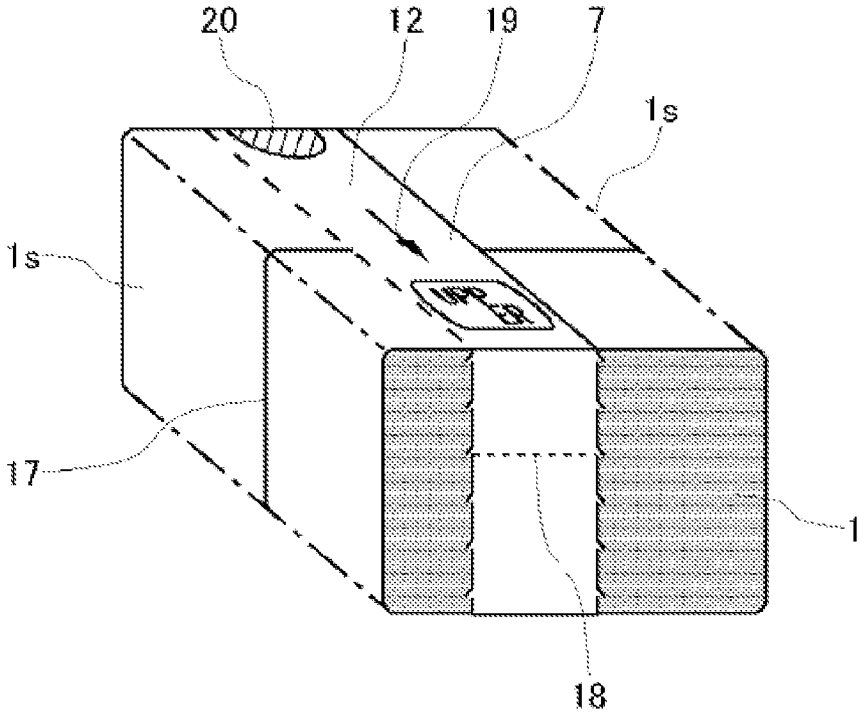
FIG. 2 is a perspective view showing a state in which the side faces of the shuffled playing cards of Embodiment 1 of the present invention are exposed.

FIG. 2 is a perspective view showing a state in which side faces is of the shuffled playing cards 1 are exposed. The shuffled playing cards 1 are made up of a predetermined number of decks, and for example, in the case of eight decks of shuffled playing cards 1, there are 416 cards. The shuffled playing cards 1 are shuffled by a conventional card shuffling device in advance in order for them to be arranged in a random order, housed in the packing box 2 that encases the shuffled playing cards 1, sealed with a sealing material or a shrink packaging material, and then supplied to casinos or the like. Note that FIG. 1 shows a state in which the packing boxes 2 housing the shuffled playing cards 1 each have attached thereon a bar code 14 (also serving as a seal), the bar codes 14 having mutually different ID codes (identification codes). The sets of shuffled playing cards 1 have mutually different card arrangement orders due to shuffling, and thus, each set is unique. Therefore, in order to identify each set, an ID code is used in the form of a bar code 14 or a QR (quick response) code. The ID code uniquely identifies each set of shuffled playing cards. In an exemplary embodiment, an RFID (or a RF-tag) may be attached as the ID code.

Figure 5:
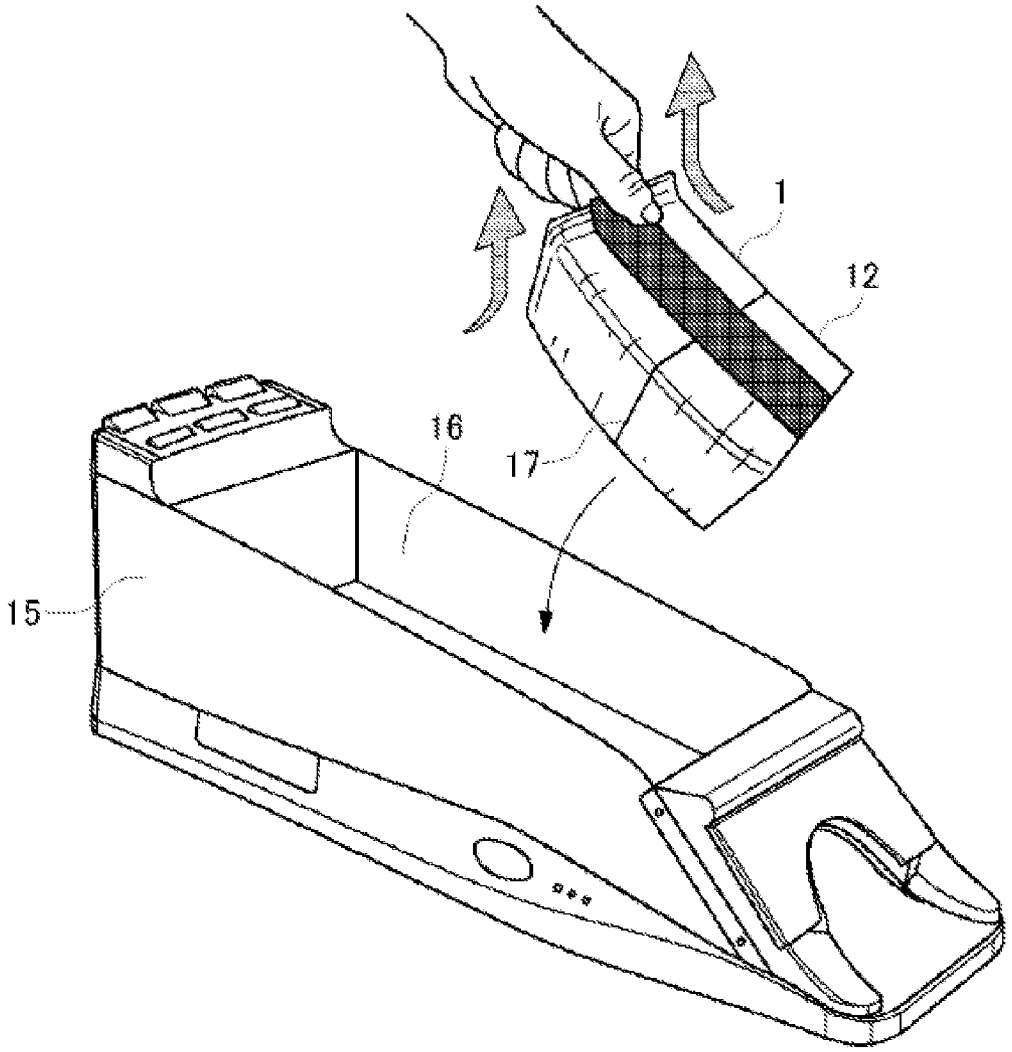
FIG. 5 is a schematic diagram showing a state in which the shuffled playing cards are housed in a shooter.

Next, with reference to FIGS. 5 and 6, a method of housing the shuffled playing cards 1 in a shooter 15 that is used in a casino or the like will be described. When the shuffled playing cards 1 are housed in the card shooter 15 to be used in a casino or the like, the zippers 11 are removed along the cut lines 10 such as zipper lines and then the left and right side faces 5 and 6 of the packing box 2 are removed as described above, thereby exposing the side edges 1*s* of the shuffled playing cards 1 as shown in FIGS. 2 and 5. Thereafter, the shuffled playing cards 1 are held at a corner portion of the central band 12 and lifted, and then housed in a card housing portion 16 of the card shooter 15 for card games, as shown in FIG. 5. The procedure for this will be described in detail below.

In the packing box 2 where the shuffled playing cards 1 are housed, circled numbers 1 to 3 indicating the procedural order for removing the zippers 11 are printed on the zippers 11, as shown in FIG. 1. In accordance with this order, as shown in FIG. 6-1, the portion on the left of a zipper 11 is removed first to remove the left side face 5 of the packing box 2, thereby exposing one side edge of each of the shuffled playing cards 1 within the packing box 2 (a first side edge exposure step). This first side edge exposure step may further include a card cut step of inserting a cut card 17, which is used at a casino in order to stop the use of the shuffled playing cards 1 in the middle of games after that game as appropriate, into the shuffled playing cards 1. The card cut step of inserting a cut card 17 into the shuffled playing cards 1 allows for: 1) dividing of the shuffled playing cards 1 into two parts by the cut card (the first half and second half) and then 2) exchanging positions of the two halves (the first half should be the backward position to the cut card and the second half should be in front position). This step is so called normally the "cut" in a card game. After the first "cut", the cut card may again be inserted into the shuffled playing cards 1 at casinos in order to stop the use of the shuffled playing cards 1 going forward or after a few games after the cut card appears.

Figure 4:
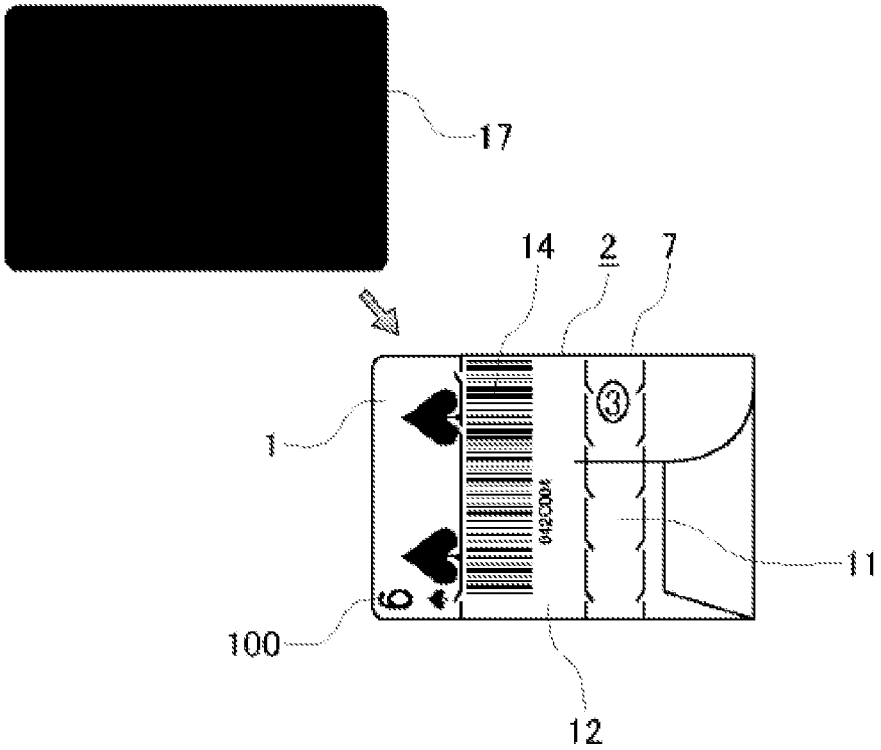
FIG. 4 is a diagram showing a state in which a cut card is inserted in the shuffled playing cards.

FIG. 4 illustrates that card cut step. Since a player (customer) of the casino is requested to insert the cut card 17 into the shuffled playing cards 1 as the "cut", there may be cheating if an index 100 of a shuffled playing card 1 at the place of insertion is seen when inserting the cut card 17. Therefore, the shuffled playing cards 1 may be housed in the packing box 2 in advance such that when the cut card 17 is inserted, the side on which the index of the shuffled playing cards 1 is not printed (the upper left portion of the upper face 7) is on top (see FIG. 4). The procedural order for removing the zippers 11 may be indicated with the circled numbers printed on the zippers 11 such that the cut card 17 can be inserted from the left side edges 1*s* where the shuffled playing cards 1 are exposed.

Figure 3:
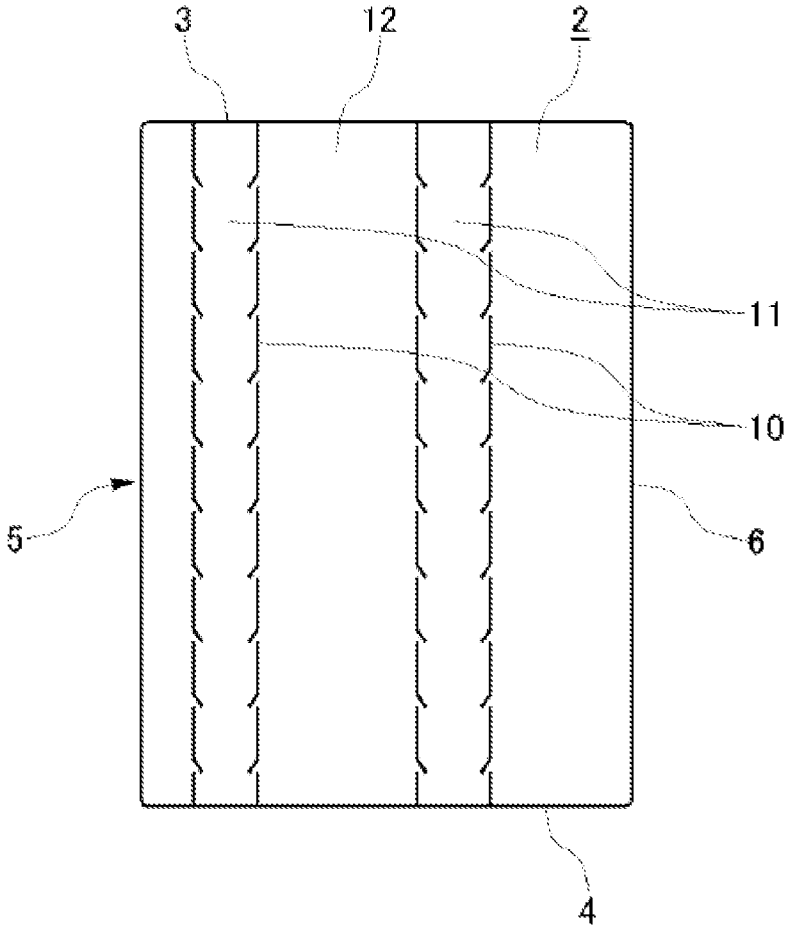
FIG. 3 is a bottom view of a packing box of the shuffled playing cards according to an exemplary embodiment of the present invention.
Figure 6:
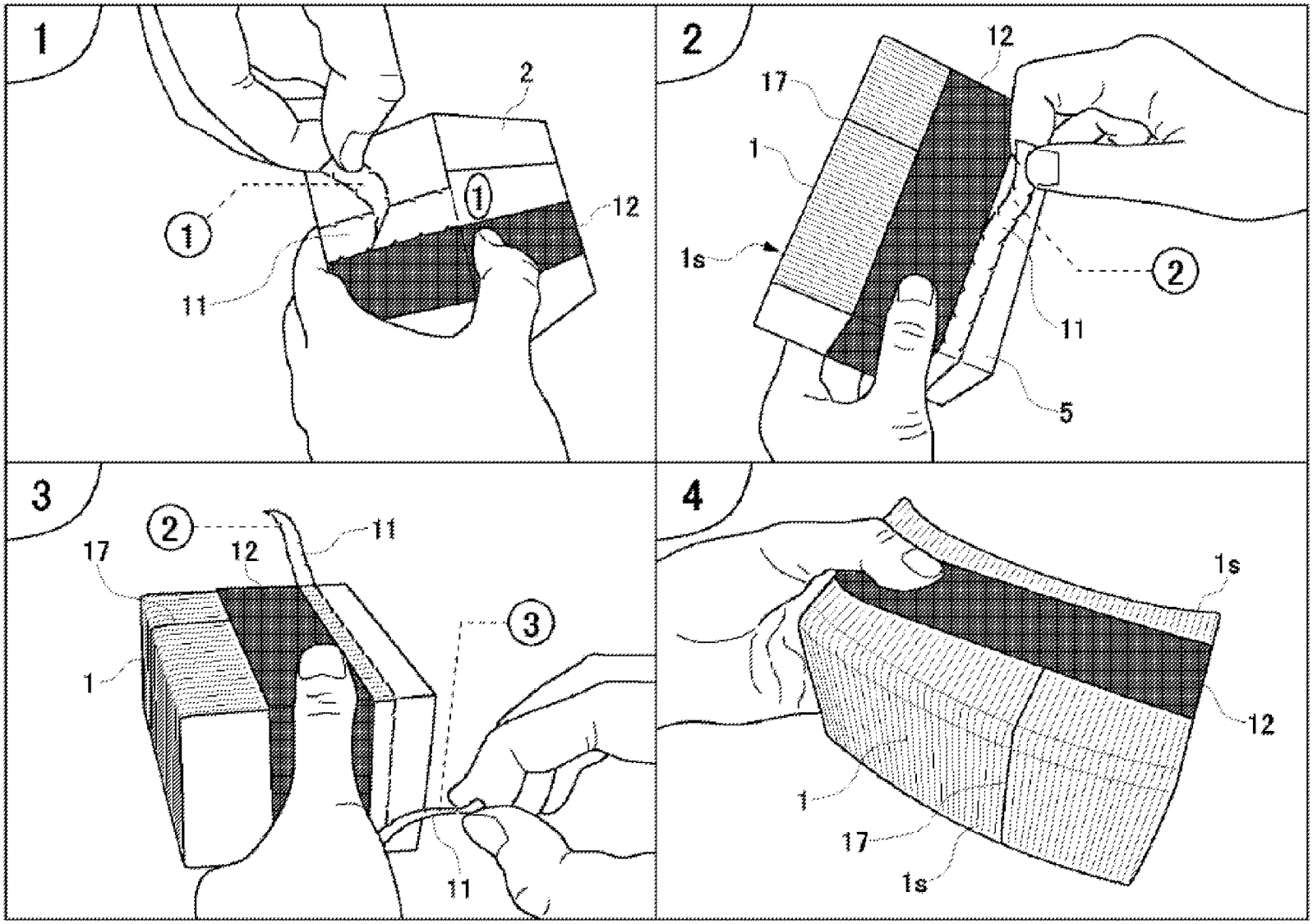
FIG. 6 is a diagram illustrating a procedure according to an exemplary embodiment of the present invention for housing the shuffled playing cards in a shooter.

Next, as illustrated in FIGS. 6-2 and 6-3, the other zipper 11 of the packing box 2 on the other side is removed in the order indicated by the circled numbers 2 and 3, and the right side face 6 of the packing box 2 is removed to expose the other side edges of the shuffled playing cards 1 within the packing box 2, thereby achieving a state in which the shuffled playing cards 1 are wrapped only with the central band 12 (a second side edge exposure step) (see FIG. 2). Next, as illustrated in FIG. 6-4, the rear corner of the central band 12 is held to lift together the shuffled playing cards 1 and the central band 12 (a lifting step). While the shuffled playing cards 1 and the central band 12 are lifted together, the shuffled playing cards 1 and the central band 12 are housed in the card housing portion 16 of the card shooter 15, as shown in FIG. 5 (a housing step). Next, the central band 12 is torn at a portion thereof (e.g., a break line 18) to remove the central band 12 from the card housing portion 16, thereby completing the housing with only the shuffled playing cards 1 left in the card housing portion 16 (a housing completion step). Note that as illustrated in FIG. 6-4, the bar code 14, or other form of ID code, remains in the central band 12. Since the bar code 14 or other form of ID code remains in the central band 12, it is advantageous to retain the central band 12 after removal without discarding the same, and to dispose of or the like the shuffled playing cards 1 after the use thereof in the game by putting the shuffled playing cards 1 in a carton bag for disposal, with the corresponding central band 12 including the bar code 14 or other form of ID code attached thereto, so as to manage the disposal of each set of shuffled playing cards 1 while maintaining the connection with the housing of the cards 1 in the card shooter 15 with a computer or the like, by reading the bar code 14 or other form of ID code with a reader (not shown in the drawings).

In Embodiment 1, the top face 7 of the packing box 2 has a marking (UPPER) indicating that it is the top face, and an arrow 19 indicating the orientation of the shuffled playing cards 1 when inserted in the card housing portion 16 (indicating the front/rear of the shuffled playing cards 1), making it possible to house the shuffled playing cards 1 in the card shooter 15 in the proper orientation without fail. Normally, when housed in the card shooter 15, the shuffled playing cards 1 are housed such that their rear faces with the pattern thereon are in front. In addition, a sign (for example, a mark 20) that indicates the place where the central band 12 is to be held and lifted is printed on the central band 12 of the packing box 2, and thus, the place for lifting can be readily found.

The shuffled playing cards for use in table card games, the housing box of the shuffled playing cards and the method of housing the same in a card shooter of the present invention enable the easy handling of a plurality of decks of shuffled playing cards and the proper housing of the shuffled playing cards in a card shooter, and thus, is useful for table card games held in casinos or the like.

Figure 7:
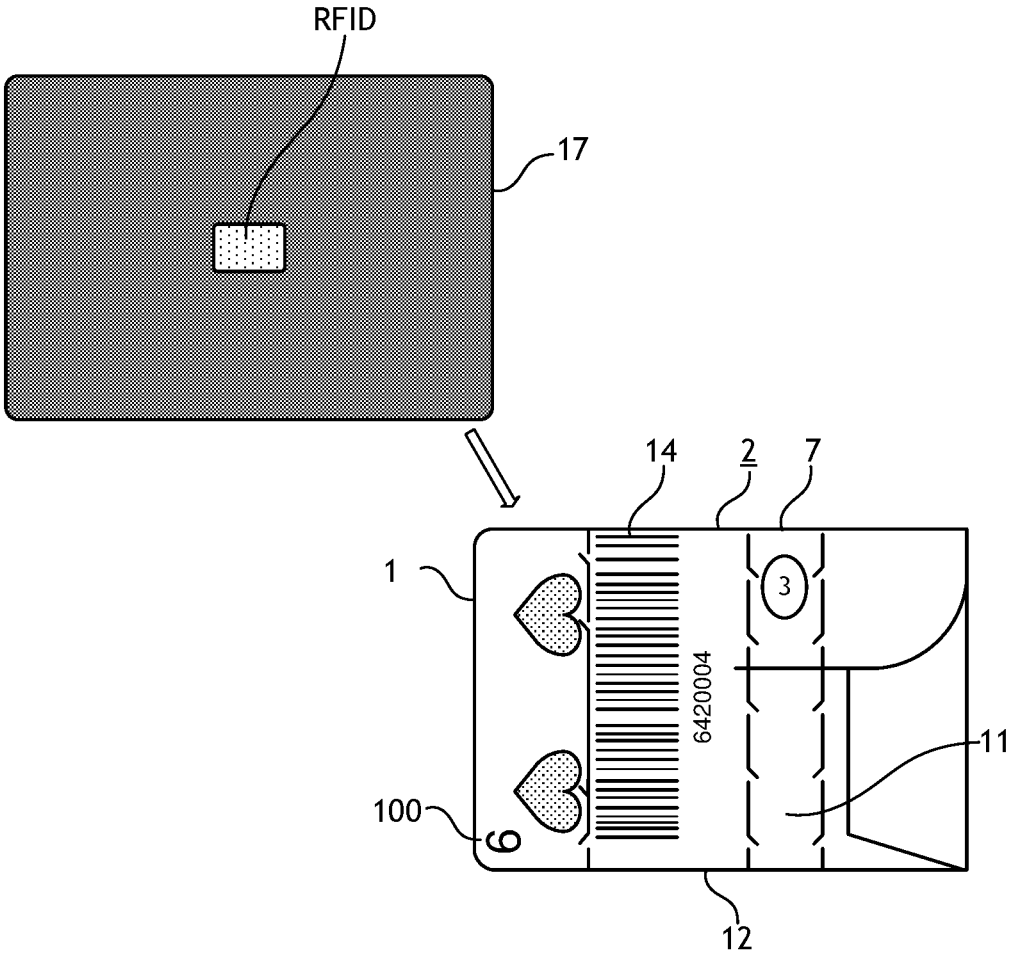
FIG. 7 shows a cut card being inserted into a package of shuffled playing cards according to an exemplary embodiment of the present invention.

As shown in FIG. 7, an RFID (or a RF-tag) may be attached as the ID code to the cut card 17 instead of attaching an RFID (or a RF-tag) to the packing box 2. In this case, the cut card 17 may be inserted into the shuffled playing cards 1 when they are packaged in the factory. This is advantageous in that it obviates the need for casinos to prepare the cut card 17 for the "cut". The cut card 17 is inserted at the left side or right side of the shuffled playing cards 1 in this case and the player (customer) or dealer of the casino may easily find and pick the cut card 17 in the package box 2. In this case the RFID (or a RF-tag) may not be attached to the package box 2 but the ID code may still be easily read from the RFID on or in the cut card 17 and the ID code uniquely identifies each set of shuffled playing cards.

Figure 8:
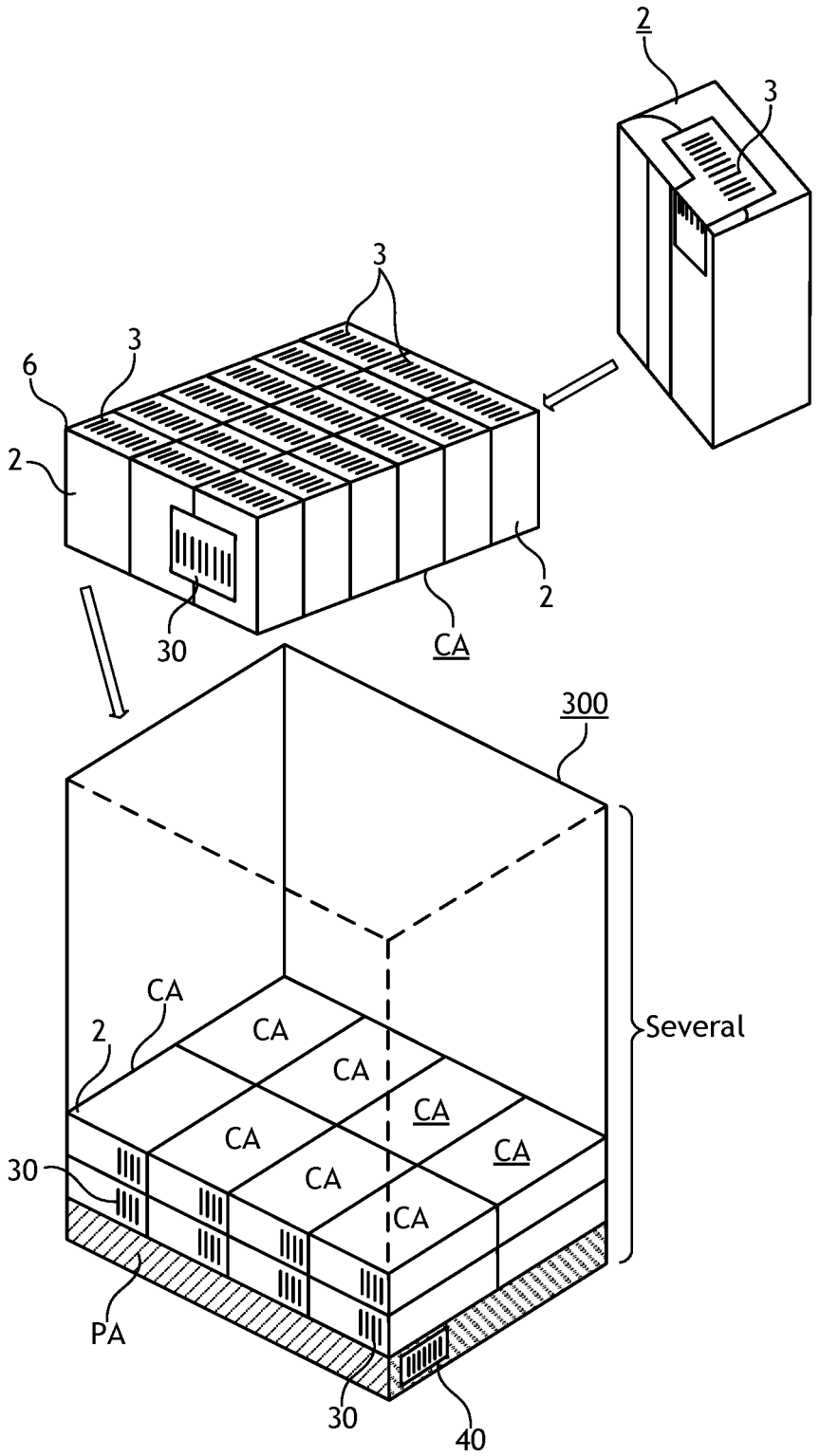
FIG. 8 are perspective views of a package of shuffled playing cards, a carton containing multiple packages of shuffled playing cards and a container containing multiple cartons according to an exemplary embodiment of the present invention.

According to an exemplary embodiment of the invention, multiple packing boxes 2 of shuffled playing cards are contained in a carton CA and multiple cartons CA are contained in a container 300 disposed on a pallet PA. As shown in FIG. 8, a carton ID including an RFID and a carton barcode 30 are attached to the each carton CA, and a container ID including an RFID and a container barcode 40 are attached to the container 300, and each carton ID and the container ID provides all information related to the ID codes of the packaging boxes 2 of shuffled playing cards contained in the carton CA or the container 300. The carton IDs may be registered in a database and associated with the ID codes of the packaging boxes 2 of shuffled playing cards contained in the carton CA and the container ID may be registered in a database and associated with the carton IDs of the cartons CA contained in the container 300 and also associated with all of the packaging boxes 2 of shuffled playing cards contained in the container 300. The carton ID or the container ID may be used to register all of the ID codes of the packaging boxes 2 upon delivery to a casino.

Now that the preferred embodiments of the present invention have been shown and described in detail, various modifications and improvements thereon will become readily apparent to those skilled in the art. Accordingly, the spirit and scope of the present invention is to be construed broadly and not limited by the foregoing specification.

What is claimed is:

1. A package of playing cards, the package having, in an assembled state, a shape of a rectangular parallelepiped, a length of which is in a longitudinal direction, the package comprising:

six faces including a front face, a rear face, a right side face, a left side face, a top face, and a bottom face;

at least one cut line arrangement formed by parallel cut lines in the longitudinal direction of the package in the assembled state, the at least one cut line arrangement configured to enable detachment of a first face of the six faces or a second face of the six faces of the package from a remaining portion of package to expose at least a portion of the playing cards contained in the package, the first face opposite the second face; and a marking showing a first place in an order of steps for removing one of the first face or the second face of the package so that an index surface of each of the playing cards, on which an index is printed, is not located in an upward direction of an exposed part of the playing cards while the one of the first face or the second face of the package is detached for inserting a cut card.

2. The package according to claim 1, further comprising another mark indicating the top face as a top surface of the package of the playing cards.

3. The package according to claim 1, further comprising another mark indicating a correct orientation of the playing cards to a front or rear of the package.

4. The package according to claim 1, further comprising a plurality of step marks that indicate one or more steps to remove the package from the playing cards, the plurality of step marks including the marking.

5. The package according to claim 1, further comprising a start marking that indicates a portion of the package intended to be detached from the package to enable insertion of the cut card.

6. The package according to claim 1, wherein the playing cards of the package form one of a plurality of card sets, the package further comprising an ID code that is unique to a playing card set formed by the playing cards of the package.

7. The package according to claim 6, further comprising a bar code or radio frequency identification (RFID) for indicating the ID code.

8. The package according to claim 1, comprising:

a first cut line arrangement of the at least one cut line arrangement, the first cut line arrangement configured to enable detachment of the first face of the package; and a second cut line arrangement of the at least one cut line arrangement, the second cut line arrangement configured to enable detachment of the second face of the package.

9. The package according to claim 1, wherein:

the playing cards are operable to be set in a card shooter with the remaining portion after the detachment; and the remaining portion is operable, after being set in the card shooter with the playing cards, to be removed from the card shooter so that the playing cards are set in the card shooter without the package.

10. The package according to claim 1, wherein the playing cards included in the package in the assembled state include one or more decks sealed in the package in a shuffled state.

11. The package according to claim 1, further comprising:

a break line; and wherein the break line is on a region of the remaining portion that borders the at least one of the parallel cut lines on the same one of the six faces as that on which at least a portion of the at least one of the parallel cut lines is arranged; and wherein the break line is configured to enable the region to be torn.

12. The method of claim 11, further comprising, prior to detaching the first face or the second face of the package, orienting the package containing the playing cards so that an index surface of each playing card of the playing cards, on which an index is printed, is not in an upward direction of the portion of the exposed portion of the playing cards while the first face or the second face of the package is detached for inserting the cut card.

13. The package according to claim 1, wherein at least one cut line arrangement includes:

a first cut line arrangement formed by first parallel cut lines in the longitudinal direction of the package in the assembled state; and a second cut line arrangement formed by second parallel cut lines in the longitudinal direction of the package in the assembled state.

14. The package according to claim 1, wherein the first face is the left side face and the second face is the right side face.

15. A method of setting shuffled playing cards in a shooter, wherein the shuffled playing cards comprise one or more decks of playing cards shuffled in a random order and contained in a package, the package has, in an assembled state, a shape of a rectangular parallelepiped, a length of which is in a longitudinal direction, wherein the package includes (a) six faces including a front face, a rear face, a right side face, a left side face, a top face, and a bottom face, (b) at least one cut line arrangement formed by parallel cut lines in the longitudinal direction of the rectangular parallelepiped in the assembled state, the at least one cut line arrangement being configured to enable detachment of a first face of the six faces or a second face of the six faces of the package from a remaining portion of package to expose at least a portion of the playing cards contained in the package, and (c) a marking showing a first place in an order of steps for removing one of the first face or the second face of the package so that an index surface of each playing card, on which an index is printed, is not located in an upward direction of an exposed part while removing the one of the first face or the second face is detached for inserting a cut card.

16. The method of claim 15, further comprising, prior to detaching the first face or the second face of the package, orienting the package containing the playing cards so that an index surface of each playing card of the playing cards, on which an index is printed, is not in an upward direction of the portion of the exposed portion of the playing cards while the first face or the second face of the package is detached for inserting the cut card.

17. The package according to claim 13, further comprising:

a break line configured to enable a region of the package between the first cut line arrangement and the second cut line arrangement to be torn after detachment of the first face or the second face using the at least one cut line arrangement; and wherein:

the break line extends between the first cut line arrangement and the second cut line arrangement, or the break line is on the region on a same one of the six faces as that on which at least a first portion of the first cut line arrangement and a second portion of the second cut line arrangement is arranged, or the break line is structured such that, after detachment of the first face and the second face from a portion of the package including at least the region, a subsequent complete tearing of the break line causes the playing cards to be completely free of the package.

18. The package according to claim 17, wherein:

the break line extends between the first cut line arrangement and the second cut line arrangement; and an end of the break line is arranged at one of the parallel cut lines.

19. The package according to claim 1, further comprising:

a break line included in a region of the package; and wherein the break line is configured to be torn, after detachment of the first face or the second face, to thereby remove the region of the package away from the playing cards such that the package is completely removed from the playing cards.

20. The package according to claim 19, wherein an end of the break line is arranged at one of the parallel cut lines.

21. The package according to claim 17, wherein the break line is structured such that, after detachment of the first face and the second face from a portion of the package including at least the region, a subsequent complete tearing of the break line causes the playing cards to be completely free of the package.

22. The package according to claim 17, wherein:

the break line extends between the first cut line arrangement and the second cut line arrangement, the break line is on the region on the same one of the six faces as that on which the at least the first portion of the first cut line arrangement and the second portion of the second cut line arrangement is arranged, the break line is structured such that, after detachment of the first face and the second face from the portion of the package including at least the region, the subsequent complete tearing of the break line causes the playing cards to be completely free of the package.

23. The method of claim 15, wherein the first face is the left side face and the second face is the right side face.

* * * * *